US007748429B2

(12) United States Patent
Caire et al.

(10) Patent No.: US 7,748,429 B2
(45) Date of Patent: Jul. 6, 2010

(54) PATIO COVER AND STORM PROTECTION DEVICE

(76) Inventors: Marie France Caire, P.O. Box 2672, Carefree, AZ (US) 85377; Serge Venezia, P.O. Box 2672, Carefree, AZ (US) 85377

( * ) Notice: Subject to any disclaimer, the term of this patent is extended or adjusted under 35 U.S.C. 154(b) by 0 days.

(21) Appl. No.: 12/427,976

(22) Filed: Apr. 22, 2009

(65) Prior Publication Data

US 2010/0139872 A1 Jun. 10, 2010

Related U.S. Application Data

(60) Provisional application No. 61/120,924, filed on Dec. 9, 2008.

(51) Int. Cl.
*E06B 3/48* (2006.01)

(52) U.S. Cl. ..... 160/113; 160/201; 160/46; 52/66

(58) Field of Classification Search ..... 160/113, 160/201, 46; 52/66, 73, 74; 135/88.01; 296/163
See application file for complete search history.

(56) References Cited

U.S. PATENT DOCUMENTS

| | | | | | |
|---|---|---|---|---|---|
| 2,229,908 | A | * | 1/1941 | Wenneborg | 52/66 |
| 3,662,410 | A | * | 5/1972 | Lankheet | 4/498 |
| 3,980,121 | A | | 9/1976 | McKee | |
| 4,088,172 | A | | 5/1978 | Pollock | |
| 4,301,851 | A | * | 11/1981 | Gitkin | 160/46 |
| 4,350,199 | A | * | 9/1982 | Pino | 160/201 |
| 4,405,008 | A | | 9/1983 | Hazlett | |
| 4,557,310 | A | * | 12/1985 | Castellaw et al. | 160/84.06 |
| 4,655,010 | A | * | 4/1987 | Arquati | 52/63 |
| 4,658,877 | A | | 4/1987 | Quinn | |
| 4,726,410 | A | * | 2/1988 | Fresh | 160/84.06 |
| 4,854,363 | A | * | 8/1989 | Fouquet | 160/98 |
| 4,882,795 | A | * | 11/1989 | Baus | 4/607 |
| 5,090,337 | A | * | 2/1992 | Magistrelli | 108/67 |
| 5,259,432 | A | * | 11/1993 | Danieli | 160/66 |
| 5,307,855 | A | * | 5/1994 | Martensson, IV | 160/66 |
| 5,752,556 | A | | 5/1998 | Steadman | |
| 5,794,679 | A | * | 8/1998 | Williams et al. | 160/46 |
| 5,865,235 | A | * | 2/1999 | Krupke et al. | 160/191 |
| 6,098,693 | A | * | 8/2000 | Frey, Jr. | 160/67 |
| 6,408,925 | B1 | * | 6/2002 | Dorma | 160/191 |
| 6,655,443 | B2 | * | 12/2003 | Mochizuki et al. | 160/201 |
| 2002/0162634 | A1 | * | 11/2002 | Dorma | 160/201 |
| 2003/0037888 | A1 | * | 2/2003 | Mochizuki et al. | 160/201 |
| 2006/0137832 | A1 | * | 6/2006 | Alexander | 160/113 |

* cited by examiner

*Primary Examiner*—Katherine W Mitchell
*Assistant Examiner*—Philip S Kwon
(74) *Attorney, Agent, or Firm*—Veronica-Adele R. Cao; Weiss & Moy, P.C.

(57) ABSTRACT

An adjustable patio cover and storm protection device capable of remote operation which acts as a security screen that prevents access through a doorway or window to which it is coupled, reduces the amount of light able to pass through the doorway or window, and also acts as a storm barricade when in its closed or down/vertical position, and which acts as an awning or sun shade that provides shade for the area in front of the door or window to which it is coupled when it is in its open or up/horizontal position.

18 Claims, 7 Drawing Sheets

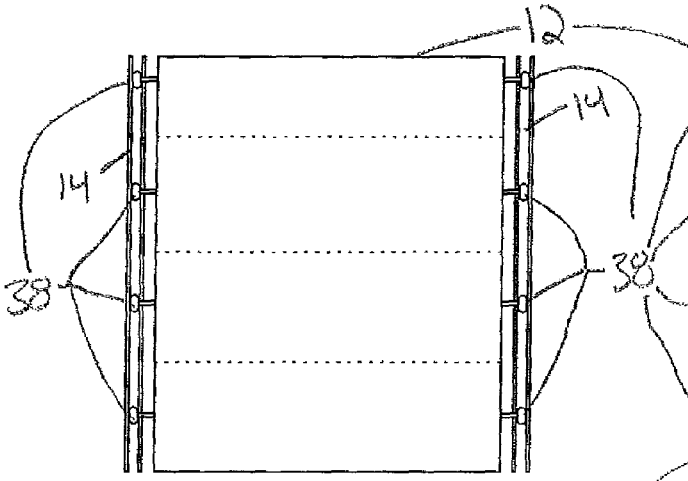
Fig. 11
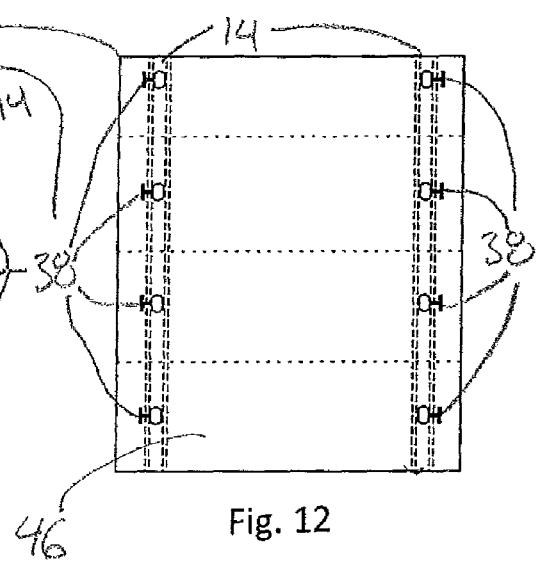
Fig. 12
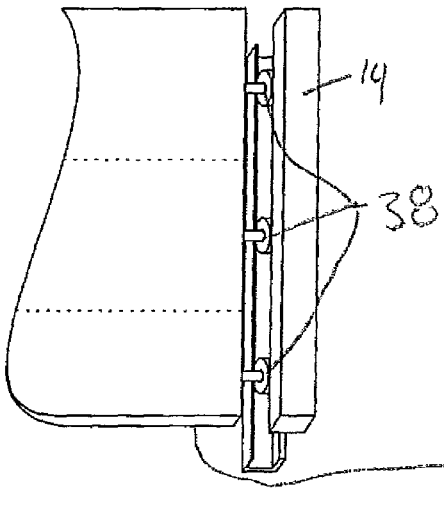
Fig. 11A
Fig. 12A
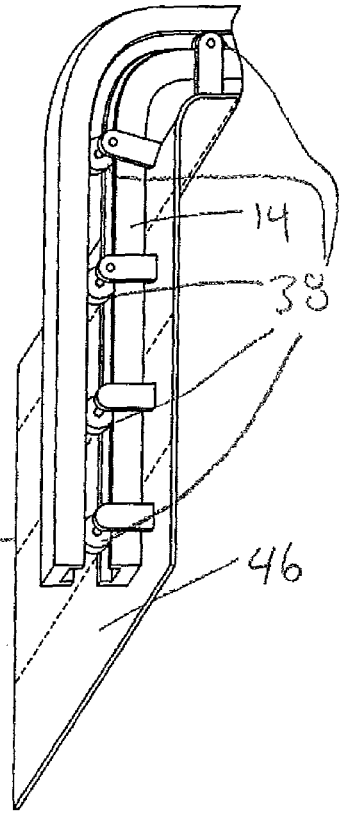

PATIO COVER AND STORM PROTECTION DEVICE

CROSS-REFERENCE TO RELATED APPLICATIONS

This application claims priority to corresponding provisional applications U.S. Ser. No. 61/120,924, filed Dec. 9, 2008 in the name of the applicants of this application.

FIELD OF THE INVENTION

The present invention relates to patio awnings and security screens/storm barricades, and more specifically, to a device capable of remote operation that functions as a security screen, reducing light and preventing access into a building, and that also functions as a storm barricade when in its closed or down/vertical position, and that functions as a patio cover or awning capable of providing shade when in its open or up/horizontal position.

BACKGROUND OF THE INVENTION

Home security has taken numerous shapes and forms over the ages. Many inventions have sought to accomplish security in various forms with various constraints in mind, such as appearance, ease of operation, and cost. Some of the most easily used forms of home security, as well as the most cost effective, have been in the form of security screens. However, designing these security screens to be aesthetically pleasing in their open position has proven to be a difficult task.

Additionally, various shading devices, including different designs of patio covers or awnings, are present on the market. However, many of the various forms of shading devices have lacked the function of being removable or retractable, preventing the user from moving or hiding the shading device when desired. Furthermore, constructing a patio cover has also proven to be difficult and expensive task.

Furthermore, in geographic areas that are prone to seasonal storms, the availability of an effective, remotely operable retractable storm barricade enables property owners to have their residences readily securable at all times of the year and also enables property owners to secure their residences against the weather without being forced to travel to the residence itself and without having to take part in the physically demanding task of boarding up every entry way and window. The property owners would also be able to remotely raise the storm barricades once the storm event has subsided, thereby allowing increased light into the structure and reducing potential mildew growth.

Therefore, it would be beneficial to provide an effective remotely operable security screen that provides a retractable patio awning when the security screen is in its unused position, and that also provides a permanent yet retractable and remotely operable storm barricade.

SUMMARY OF THE INVENTION

In accordance with one embodiment, a patio cover and storm protection device is disclosed. The device is preferably a flexible garage door-like apparatus comprising a screen and a pair of tracks that curve from substantially vertical to substantially horizontal and abutting the external façade of a doorway or window. The substantially horizontal portion(s) of track will be preferably slightly pitched as to cause rain and precipitation to be directed away from the façade of the building structure when the screen is in its substantially horizontal position. The device acts as a patio door security screen as well as a storm barricade for a window or a doorway when in its closed or down/vertical position and also acts as an awning or patio cover when in its open or up/horizontal position. The device will be capable of being operated in the same fashion as a standard garage door, in which an electric motor drives the screen from one position to another. The device is preferably also capable of being operated remotely, thereby allowing a vacationing homeowner to lower the screen and create a storm barricade in an emergency despite being miles away from home. In this embodiment of the device, the length of the screen may be longer than the height of the substantially vertical portion of the tracks, thereby providing more shade in its open or up/horizontal position than it would otherwise. In such a situation, the device in its closed or down/vertical position will also have a small portion of the screen remain in a substantially horizontal position, thereby causing the device to act as both a smaller awning and as a patio door security screen/storm barricade at the same time.

In accordance with another embodiment of the present invention, a patio cover and storm protection device is disclosed. The tracks upon which the screen travels on the exterior of the building structure preferably have a shade fixture between the tracks and located at the distal end of the substantially horizontal portion of the tracks so that the shade produced while the screen is in its open or up/horizontal position is increased and extended beyond the distal end of the substantially horizontal portion of the tracks. This feature increases the stability of the device in the event of strong winds in that the screen of the device is completely flush with the façade of the building structure when in its closed or down/vertical position yet has no horizontal component exposed to the wind. Accordingly, even if the shade fixture or the tracks were damaged or destroyed by strong winds, the wind is unable to "grab" the screen itself, and the door or window covered by the screen remains covered and continues to protect the interior of the building structure.

In accordance with yet another embodiment of the present invention, a patio cover and storm protection device is disclosed. The device will preferably have an additional pair of substantially horizontal portions of track that lead inside the building structure above the top of the window or door frame to which it is coupled. Accordingly, the device will preferably have three different positions: one position being up and substantially horizontal on the exterior of the structure, thereby providing shade; one position being down and substantially vertical, thereby providing a security screen/storm barricade and preventing access through the door or window; and one position being up and substantially horizontal within the building structure to which it is attached, thereby being hidden from view.

In accordance with a further embodiment of the present invention, a patio cover and storm protection device is disclosed. The device preferably will have various water diverting mechanisms to ensure that water does not flow toward the façade of the building and to protect the various components of the device, namely the track rollers and the tracks upon which they run, from water damage. To prevent water from flowing toward the façade of the building, a small fascia will preferably be located above the curved portion of the tracks so that water is drained away from the façade of the building structure and onto the substantially horizontal screen, which then causes the water to run toward the top edge of the screen being furthest from the building structure. To protect the tracks and the track rollers, a fluid diverter consisting of a continuous piece of material is preferably positioned above the substantially horizontal portion of the tracks, causing water to run to either side of the tracks. Preferably, the tracks will be at least partially embedded in structural members, thereby making the entire device more aesthetically pleasing, although it should be understood that the device may be constructed without embedding any portion of the tracks in structural members without departing from the scope and spirit of the invention.

In any of the aforementioned embodiments, there may be a plurality of independent patio cover and storm protection devices directly next to one another. Accordingly, a user with such a plurality of devices is preferably able to provide shade for different portions of a patio while also securely protecting less than all of the portions of the building structure to which the plurality of devices are attached.

It should be noted that in each of the aforementioned embodiments, the device is capable of being integrated with a building structure while remaining in compliance with the Americans with Disabilities Act.

The features, functions, and advantages can be achieved independently in various embodiments of the disclosure or may be combined in yet other embodiments.

BRIEF DESCRIPTION OF THE PREFERRED EMBODIMENTS

In accordance with one embodiment of the present invention, a patio cover and storm protection device is disclosed, comprising, in combination, at least one screen, each screen having a front face and a back face and a first side and a second side and a top side and a bottom side, at least one track, each at least one track comprising, a substantially vertical portion having a higher end and a lower end, the substantially vertical portion being proximate a building structure, a curved portion having a vertical end and a horizontal end, the vertical end being coupled to the higher end of the substantially vertical portion, and a substantially horizontal portion having a proximate end and a distal end, the proximate end being coupled to the horizontal end of the curved portion and the distal end of the substantially horizontal portion extending away from the building structure, and at least one track roller coupled to each at least one screen, the at least one track roller dimensioned to permit the at least one screen to travel along the at least one track so that at least a portion of the at least one screen being disposed anywhere between a substantially vertical position covering the building structure and a substantially horizontal position extending away from the building structure.

In accordance with another embodiment of the present invention, a patio cover and storm protection device is disclosed, comprising, in combination, a screen having a front face and a back face and a first side and a second side and having a width equal to the distance between the first side and the second side, a first substantially vertical track having a higher end and a lower end and being proximate a building structure, a second substantially vertical track having a higher end and a lower end and being proximate the building structure and being substantially parallel to the first substantially vertical track, a first dual-curved track comprising, a vertical portion having a top and a bottom, the bottom of the vertical portion being coupled to the higher end of the first substantially vertical track, a first substantially horizontal portion coupled to the top of the vertical portion and extending in a first direction, a second substantially horizontal portion coupled to the top of the vertical portion and extending in a second direction being substantially opposite the first direction, and a track switch for causing a track roller traveling from the bottom of the vertical portion to the top of the vertical portion to transition to either the first substantially horizontal portion or the second substantially horizontal portion, a second dual-curved track comprising, a vertical portion having a top and a bottom, the bottom of the vertical portion being coupled to the higher end of the second substantially vertical track, a first substantially horizontal portion coupled to the top of the vertical portion and extending in a first direction, a second substantially horizontal portion coupled to the top of the vertical portion and extending in a second direction being substantially opposite the first direction, and a track switch for causing a track roller traveling from the bottom of the vertical portion to the top of the vertical portion to transition to either the first substantially horizontal portion or the second substantially horizontal portion, a first substantially horizontal portion of track having a proximate end and a distal end, the proximate end being coupled to the first substantially horizontal portion of the first dual-curved track, the first substantially horizontal portion of track extending away from the building structure, a second substantially horizontal portion of track having a proximate end and a distal end, the proximate end being coupled to the second substantially horizontal portion of the first dual-curved track, the second substantially horizontal portion of track extending into the building structure, a third substantially horizontal portion of track having a proximate end and a distal end, the proximate end being coupled to the first substantially horizontal portion of the second dual-curved track, the third substantially horizontal portion of track extending away from the building structure and being substantially parallel to the first substantially horizontal portion of track, a fourth substantially horizontal portion of track having a proximate end and a distal end, the proximate end being coupled to the second substantially horizontal portion of the second dual-curved track, the fourth substantially horizontal portion of track extending into the building structure and being substantially parallel to the second substantially horizontal portion of track, a first plurality of track rollers coupled to the first side of the screen and being capable of traveling along the first substantially vertical track and the first dual-curved track and the first substantially horizontal portion of track and the second substantially horizontal portion of track, and a second plurality of track rollers coupled to the second side of the screen and having a distance from the first plurality of track rollers substantially equal to the width of the screen and being capable of traveling along the second substantially vertical track and the second dual-curved track and the third substantially horizontal portion of track and the fourth substantially horizontal portion of track.

The foregoing and other objects, features, and advantages of the invention will be apparent from the following, more particular description of the preferred embodiments of the invention, as illustrated in the accompanying drawings.

BRIEF DESCRIPTION OF THE DRAWINGS

Embodiments of the disclosure will become more fully understood from the detailed description and the accompanying drawings, wherein:

FIG. 2*a* is a side perspective view of the embodiment of the device shown in FIG. 1;

FIG. 2*b* is a side perspective view of another embodiment of the patio cover and storm protection device of the present invention wherein the substantially horizontal portions of the tracks are supported by tensile members anchored to the building structure to which the device is connected;

FIG. 2*c* is a side perspective view of another embodiment of the patio cover and storm protection device of the present invention wherein the substantially horizontal portions of the tracks are supported by truss members;

FIG. 11 is a front view of another embodiment of the patio cover and storm protection device of the present invention in which the track rollers are coupled to the sides of the screen.

FIG. 11A is a front perspective view of the embodiment of the device shown in FIG. 11 demonstrating how the track rollers are engaged with the track.

FIG. 12 is a front view of another embodiment of the patio cover and storm protection device of the present invention in which the track rollers are coupled to a face of the screen.

FIG. 12A is a side perspective view of the embodiment of the device shown in FIG. 12A demonstrating how the track rollers are engaged with the track.

DETAILED DESCRIPTION OF THE PREFERRED EMBODIMENTS

Figure 1:
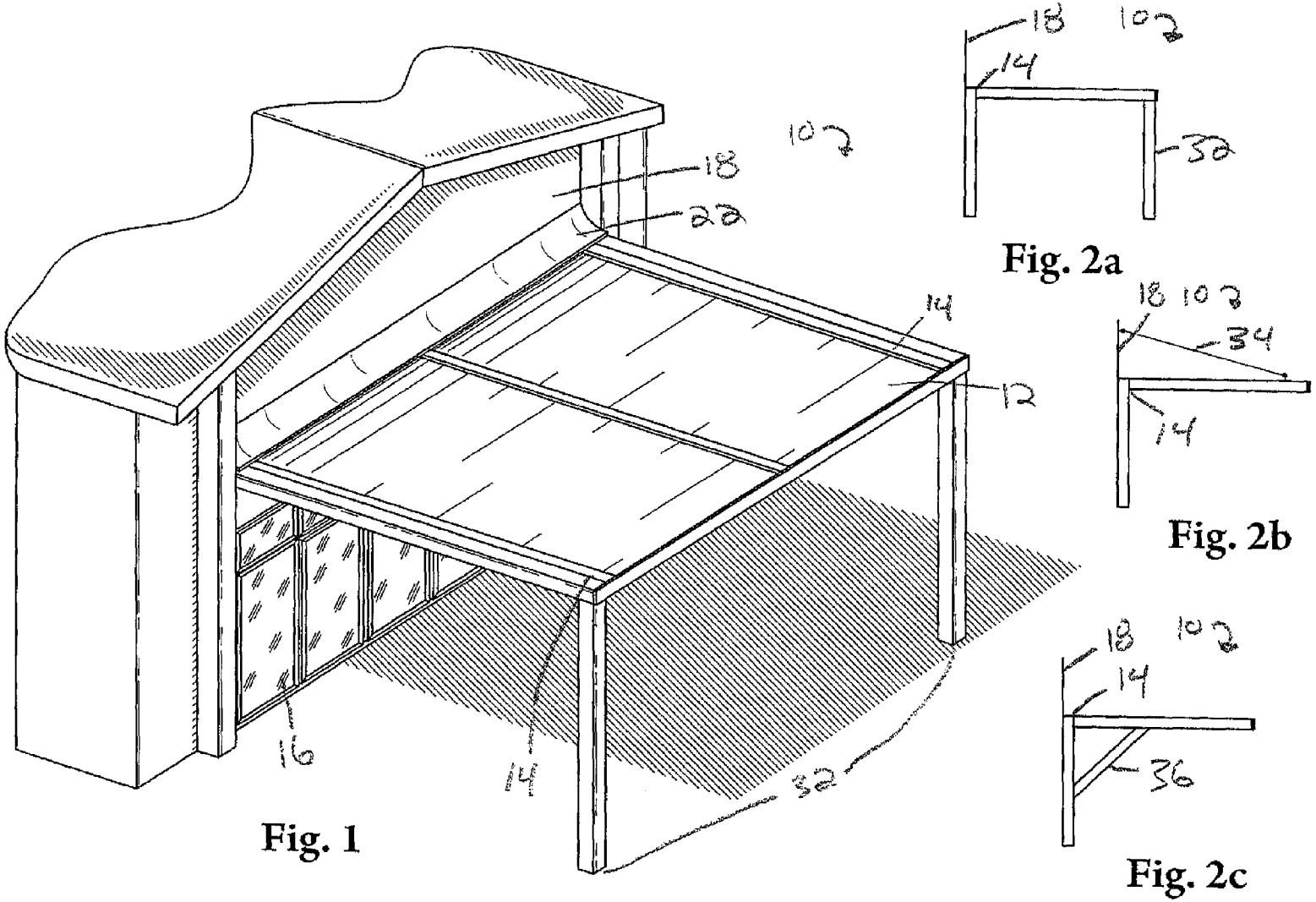
FIG. 1 is an elevated perspective view of an embodiment of the patio cover and storm protection device of the present invention and the building structure to which it is attached, the screen of the device being in a substantially horizontal position, and the substantially horizontal portion of the tracks of the device being supported by two vertical support members at the distal end of the substantially horizontal portion of the tracks.

Referring to the Figures, a patio cover and storm protection device 10 is shown. The device consists of a screen (FIGS. 1, 3-6, and 7*b*-12A) mounted upon two tracks 14 placed in front of the exterior of a door or window 16 (FIGS. 1, 3, 6, and 8) being proximate the façade 18 (FIGS. 1-7*a* and 7*c*-8) of the building structure abutting the door or window 16, and the tracks 14 curving substantially horizontally and outwardly and from the building after reaching a height at least equal to the height of the door or window 16 which is covered by the device 10 in its closed or down/vertical position. Accordingly, when the screen 12 is in its open or up/horizontal position it rests on the substantially horizontal portion of the tracks 14 at a height above the top of the door or window 16 in a substantially horizontal position, thereby enabling the device 10 to provide shade from the sun, and when the screen 12 is in its closed or down/vertical position, the device completely or partially blocks the door or window 16 thereby acting as both a patio door security screen and a storm barricade. Although this embodiment of the invention uses a pair of tracks 14 engaged with track rollers 38 coupled to each side of the screen 12, it should be understood that substantial benefit may be derived from an alternative embodiment of the present invention in which only a single track 14 engaged with track rollers 38 coupled to a single face 46 of the screen 12 without departing from the scope and spirit of the invention.

Referring to FIGS. 2*a*, 2*b*, 2*c*, 3, and 4 the different methods for supporting the substantially horizontal nature of the tracks 14 are shown. The different methods are either vertical support members 32 placed at the distal end of the substantially horizontal portion of the tracks 14 (FIG. 2*a*), tensile members 34 attached to the distal end of the substantially horizontal portion of the tracks and anchored to the façade 18 of the building structure (FIGS. 2*b* and 3), a pair of truss members 36 between the façade 18 of the building structure and the substantially horizontal portions of the tracks 14 (FIGS. 2*c* and 4), or by cantilevering the substantially horizontal portion of the tracks of the device with respect to the building structure. Although various methods of supporting the substantially horizontal portions of the tracks 14 of the device 10 are disclosed, it should be clearly understood that substantial benefit could be derived from an alternative embodiment of the present invention in which the substantially horizontal portions of the tracks 14 of the device 10 are supported by different means without departing from the scope and spirit of the invention.

Figure 3:
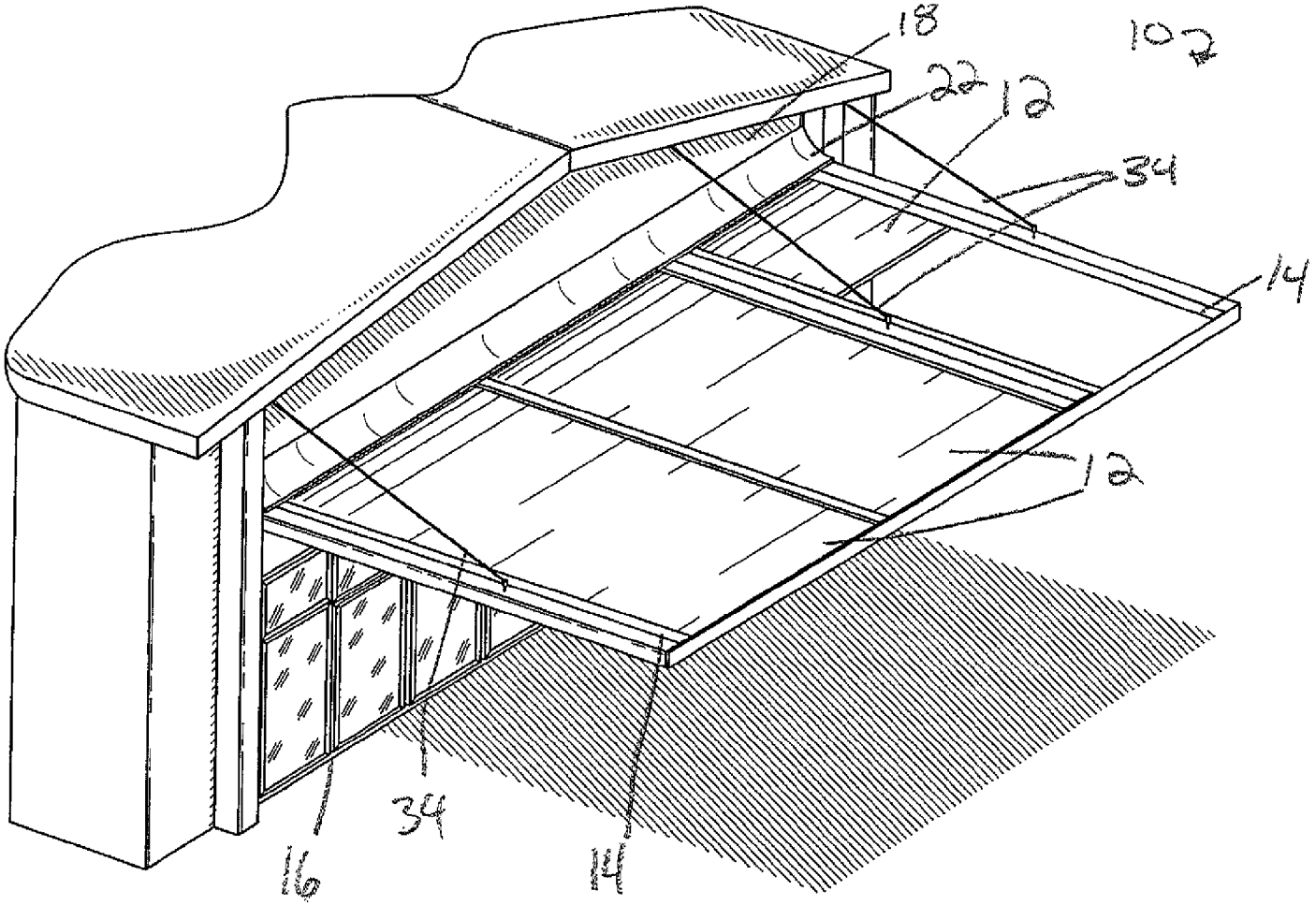
FIG. 3 is an elevated perspective view of the embodiment of the device shown in FIG. 2*b* with multiple devices placed side by side.
Figure 4:
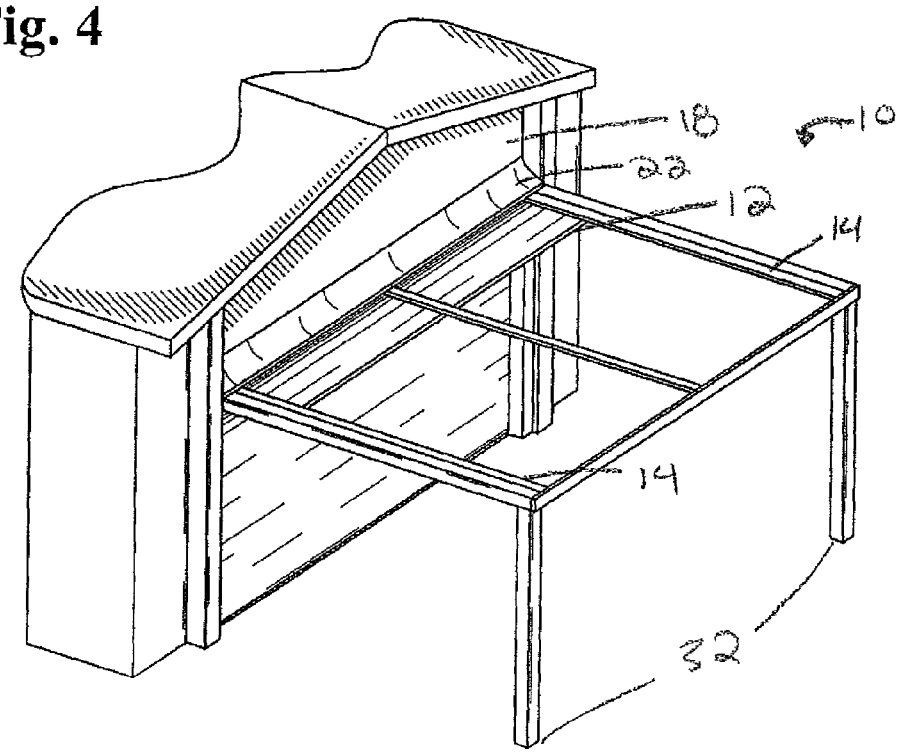
FIG. 4 is an elevated perspective view of the embodiment of the device shown in FIG. 1 wherein the screen of the device is in its fully closed or down/vertical position, while a portion of the screen is also partially in a substantially horizontal position due to the fact that the screen is slightly longer than the height of the substantially vertical portions of track.

Referring to FIG. 3, a plurality of combined patio cover and storm protection devices 10, each having a separate screen 12 with its own tracks 14, may be placed directly next to one another, thereby enabling a user of the devices to provide shade for a portion, or portions, of a patio while simultaneously securely closing off the remaining portions of the patio. Again, it should be understood that this embodiment of the invention may be practiced with a single track 14 used for each screen 12, without departing from the scope and spirit of the invention.

Figure 5:
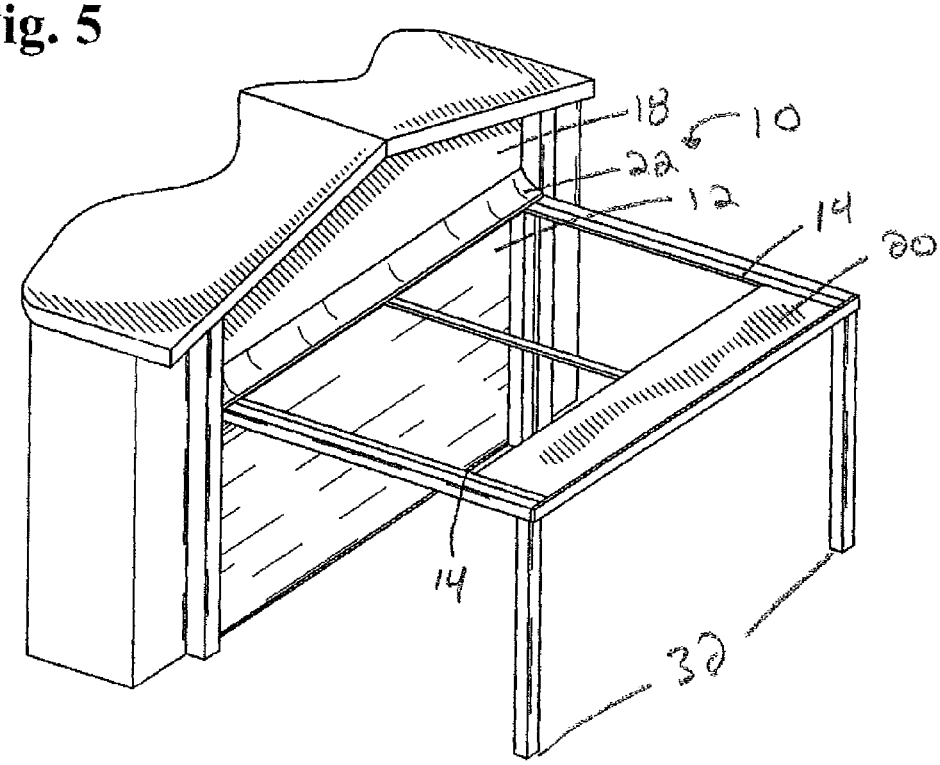
FIG. 5 is an elevated perspective view of another embodiment of the patio cover and storm protection device of the present invention wherein a shade fixture is provided at the end of the substantially horizontal portion of the tracks to provide additional shade while doing nothing to compromise the screen's integrity with respect to strong winds, as the screen will be substantially vertical and flush with the façade of the house in its closed position, thereby minimizing the screen's potential wind exposure, and making this particular embodiment more attractive for use in geographic locations that are more prone to severe weather.

Referring to FIG. 5, one embodiment of the device has, in addition to the aforementioned features of the first embodiment, a shade fixture 20 having the same width as the distance between the tracks 14 and extending horizontally and outwardly from the distal end of the substantially horizontal portion of the tracks 14, the shade fixture 20 providing extended shade. It should be clearly understood that substantial benefit could be derived from an alternative embodiment of the present invention in which no shade fixture 20 is used without departing from the scope and spirit of the invention.

Figure 8:
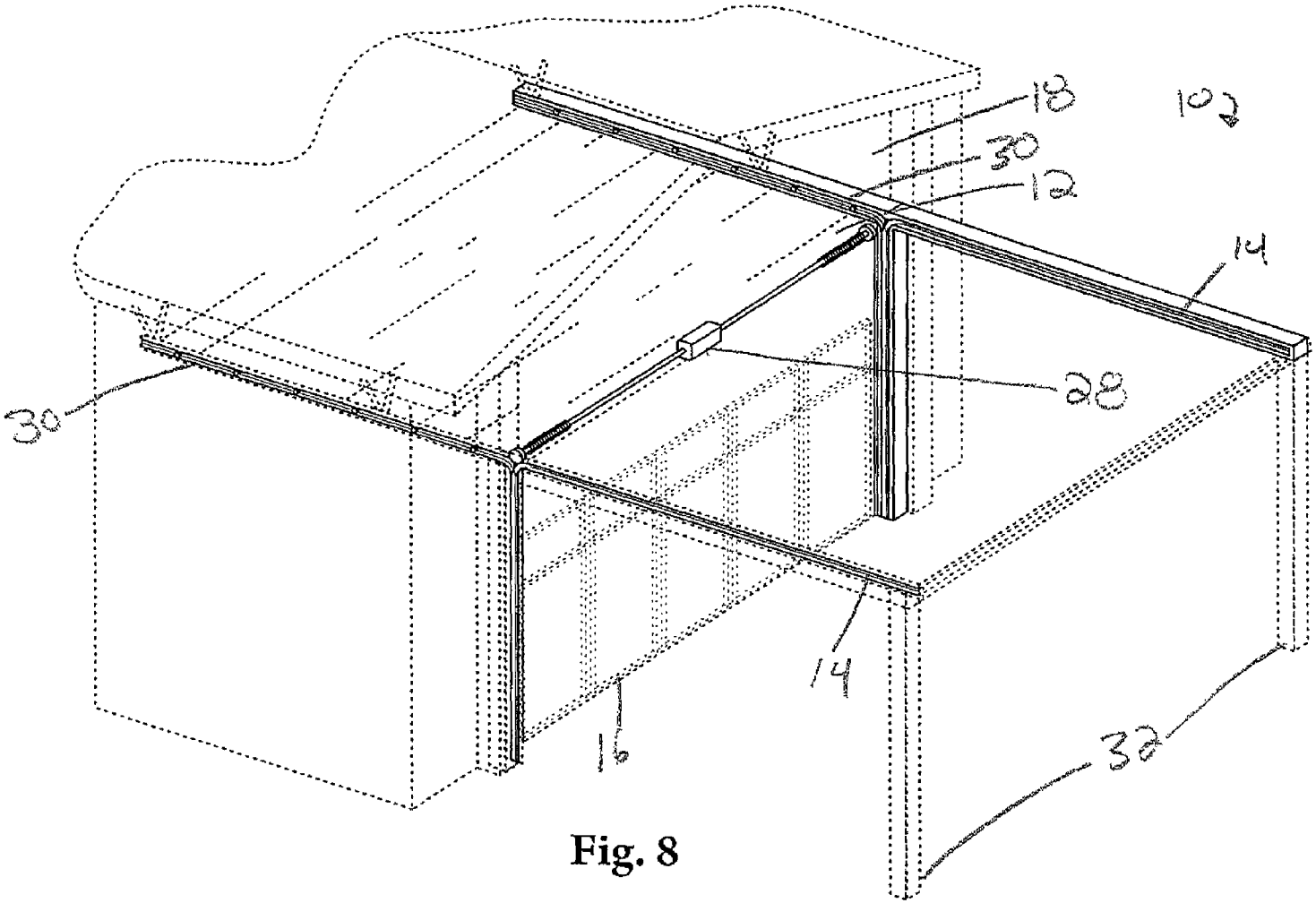
FIG. 8 is an elevated perspective view of another embodiment of the patio cover and storm protection device of the present invention wherein an additional pair of substantially horizontal portions of track enable the device to be completely hidden from view.
Figure 9:
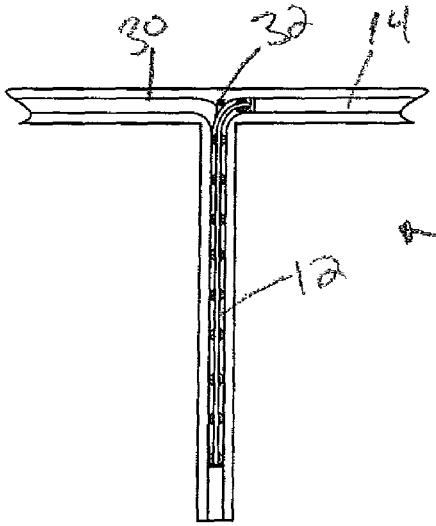
FIG. 9 is a side view of the embodiment of the device shown in FIG. 8 demonstrating the additional pair of substantially horizontal portions of tracks.
Figure 9A:
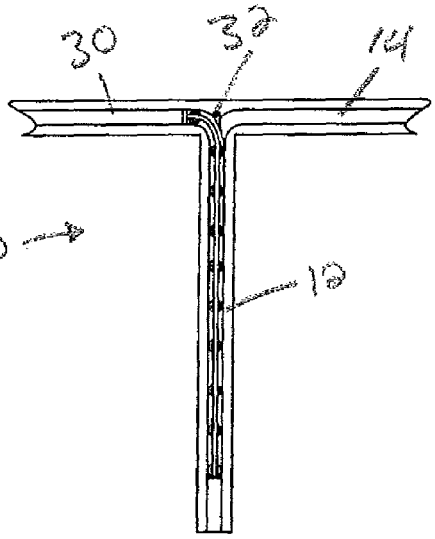
FIG. 9*a* is a side view of the embodiment of the device shown in FIG. 8 demonstrating the additional pair of substantially horizontal portions of track.

Referring to the FIGS. 8, 9, and 9*a*, an additional embodiment of the device 10 provides an additional pair of substantially horizontal portions of track 30 travelling inwardly into the building structure, and a track switch 33 between the tracks 14 and the additional pair of substantially horizontal portions of track 30, thereby allowing the screen 12 to be made completely hidden from view by placing the screen 12 within the building structure. It should be clearly understood that substantial benefit could be derived from an alternative embodiment of the present invention in which no track switch 33 or additional pair of substantially horizontal portions of track 30 are used without departing from the scope and spirit of the invention.

Referring to FIGS. 1, 3-6, 7*a*, and 7*c*, another embodiment of the device has a fascia 22 having the same width as the distance between the tracks 14 and extending horizontally over the substantially vertical portions and the curved portions of the tracks 14 and abutting the façade 18 of the building structure so that when the screen 12 is in its open or up/horizontal position the fascia 22 comes in close proximity to the bottom side of the screen 12, thereby providing continuous shade from the edge of the building structure to the top side of the screen 12 while also providing means for causing water to flow away from the façade 18 of the building structure and toward the top side of the screen 12. It should be clearly understood that substantial benefit could be derived from an alternative embodiment in which other mechanisms for diverting water may also be used, such as a series of rain gutters, or in which no mechanism for diverting water is used, without departing from the scope and spirit of the invention.

Figure 7A:
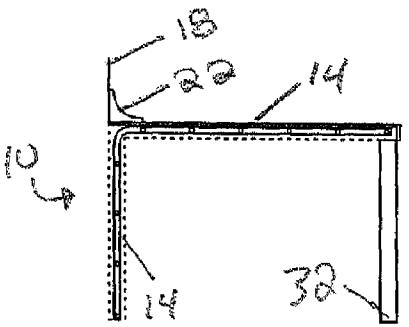
FIG. 7*a* is a side perspective view of the device as shown in FIG. 6.
Figure 7B:
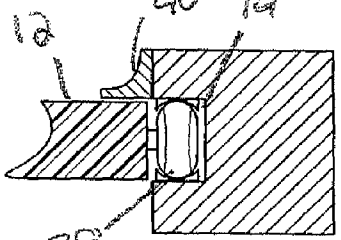
FIG. 7*b* is a cross-sectional view of another embodiment of the patio cover and storm protection device of the present invention showing the screen engaged with the tracks via track rollers coupled to the screen. Also shown is a fluid diverter for directing water away from the tracks. The tracks will preferably be embedded in structural members which hide the tracks from view, making the overall appearance of the device more aesthetically pleasing.
Figure 7C:
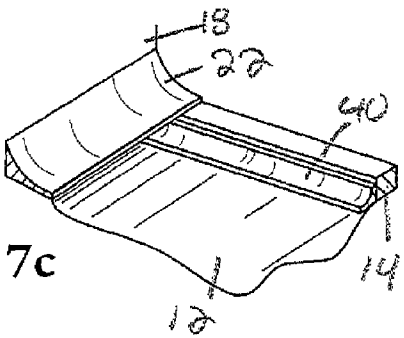
FIG. 7*c* is an elevated perspective view of another embodiment of the patio cover and storm protection device of the present invention showing the substantially horizontal portion of the tracks and a fascia covering the proximate end of the substantially horizontal portions of the tracks, the substantially vertical portions of the tracks, and the curved portion of the tracks.

Referring to FIGS. 7*b* and 7*c*, a cross-sectional view of the track 14 of the device is shown with the track rollers 38 coupled to the screen 12 shown engaged with the track (FIG. 7*b*). Additionally provided is a fluid diverter 40 positioned above the tracks 14 for directing rain and precipitation away from the tracks 14 (FIGS. 7*b* and 7*c*). It should be clearly understood that substantial benefit could be derived from an alternative embodiment of the present invention in which a different mechanism is used to divert fluid away from the tracks 14, or in which the tracks 14 are protected from weather via different means, or in which no fluid diverter 40 is used, without departing from the scope and spirit of the invention.

Figure 6:
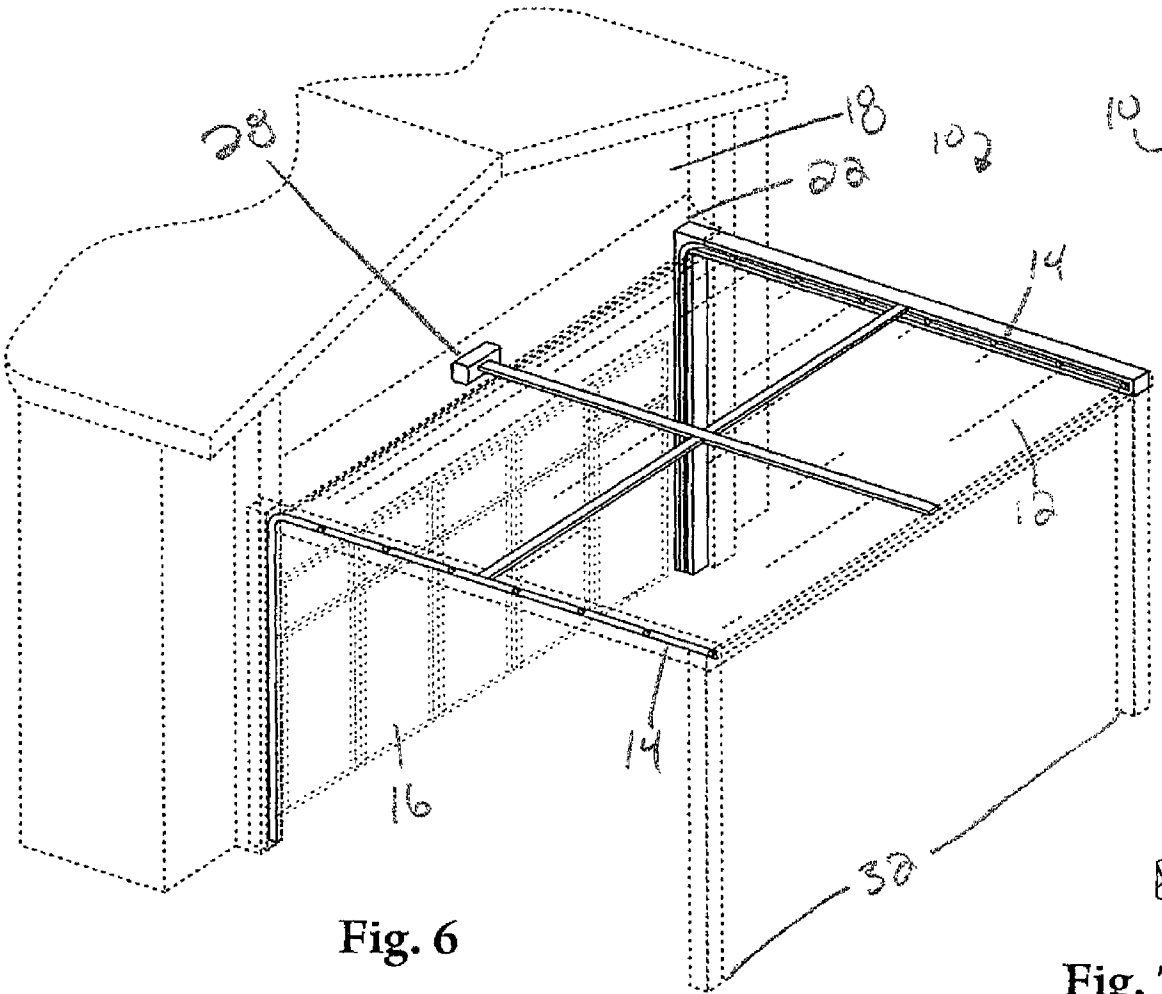
FIG. 6 is an elevated perspective view of the embodiment of the device shown in FIG. 1 with much of the building structure and the device shown in phantom in order to accentuate the tracks of the device and a portion of the driving means for moving the screen along the tracks.
Figure 10:
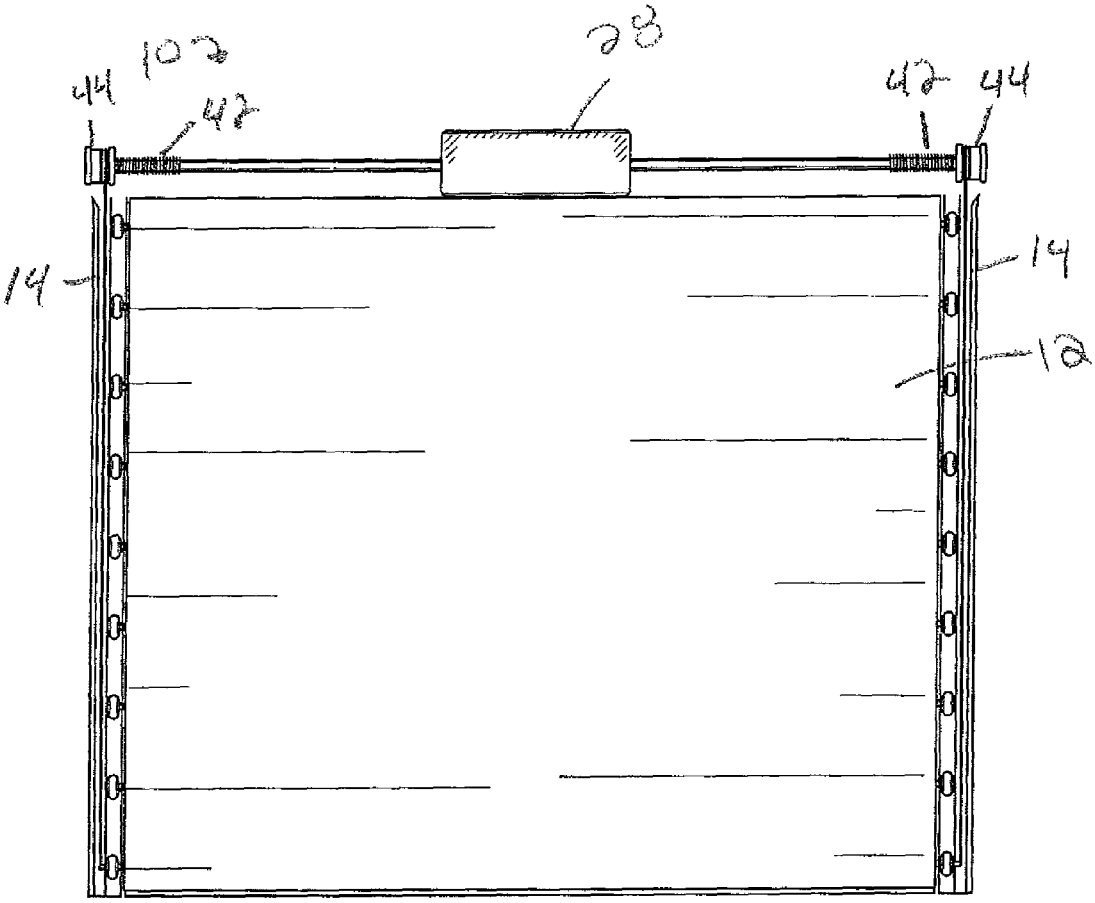
FIG. 10 is a front view of the patio cover and storm protection device of the present invention accentuating a portion of the driving means for moving the screen of the device from its substantially vertical position to one of its substantially horizontal positions.

Referring to FIGS. 6, 8, and 10, the driving mechanism 28 of the screen 12 is shown. The driving mechanism 28 may be an electric motor coupled to the screen 12 in a manner similar to common garage door openers using a torsion spring 42 and a pair of cable drums 44, or may be a simple user-operated hand-driven pulley system. The driving mechanism 28 may be operated by a localized electronic actuator, such as button, and may even be operated remotely by a secure remote actuating device. It should be clearly understood that substantial benefit could be derived from an alternative embodiment of the present invention in which no driving mechanism 28 is used without departing from the scope and spirit of the invention.

Referring to FIGS. 11 and 11A, an embodiment of the screen 12, track 14, and track rollers 38 is shown. The track rollers 38 are coupled to the side of the screen 12 and engaged with the track 14.

Referring to FIGS. 12 and 12A, an embodiment of the screen 12, track 14, and track rollers 38 is shown. The track rollers 38 are coupled to a face 46 of the screen 12 and engaged with the track 14, to allow multiple screens 12 to be placed side by side without tracks 14 in between the multiple screens 12.

While embodiments of the disclosure have been described in terms of various specific embodiments, those skilled in the art will recognize that the embodiments of the disclosure can be practiced with modifications within the spirit and scope of the invention.

We claim:

1. A patio cover and storm protection device comprising:

at least one screen, each at least one screen having a front face and a back face and a first side and a second side and a top side and a bottom side;

at least one track, each at least one track comprising;

a substantially vertical portion having a higher end and a lower end, the substantially vertical portion coupled to a building structure;

a curved portion having a vertical end and a horizontal end, the vertical end being coupled to the higher end of the substantially vertical portion; and a substantially horizontal portion having a proximate end and a distal end, the proximate end being coupled to the horizontal end of the curved portion and the distal end of the substantially horizontal portion extending away from the building structure; and at least one track roller coupled to each at least one screen, the at least one track roller dimensioned to permit the at least one screen to travel along the at least one track so that at least a portion of the at least one screen being disposed anywhere between a substantially vertical position covering the building structure and a substantially horizontal position extending away from the building structure.

2. The patio cover and storm protection device of claim 1 wherein:

the at least one track comprises:

a first track coupled proximate the building structure; and a second track coupled proximate the building structure and positioned a distance from the first track to enable at least one screen to be placed between the first track and the second track; and the at least one track roller comprises:

a first plurality of track rollers coupled proximate to the first side of the at least one screen and engaged with the first track; and a second plurality of track rollers coupled proximate to the second side of the at least one screen and engaged with the second track.

3. The patio cover and storm protection device of claim 1 further comprising a driving mechanism for causing the at least one track roller to travel along the at least one track.

4. The patio cover and storm protection device of claim 3 wherein the driving mechanism comprising an electric motor and at least one spring and at least one cable for each at least one spring, at least one cable being coupled to each at least one screen.

5. The patio cover and storm protection device of claim 3 wherein the driving mechanism being remotely operable.

6. The patio cover and storm protection device of claim 1 further comprising a substantially vertical support member having an upper end and a lower end for each track, the upper end of each substantially vertical support member being coupled proximate the distal end of the substantially horizontal portion of a corresponding track and the lower end of each substantially vertical support member being proximate a portion of ground being substantially below the distal end of the substantially horizontal portion of the corresponding track.

7. The patio cover and storm protection device of claim 1 further comprising a fluid diverter for each track, the fluid diverter having a proximate end and a distal end, the proximate end of the fluid diverter being located proximate the proximate end of the substantially horizontal portion of a corresponding track, and the distal end of the fluid diverter being located proximate the distal end of the substantially horizontal portion of the corresponding track, the fluid diverter being located substantially above the substantially horizontal portion of the corresponding track, and the fluid diverter being capable of diverting fluid away from the substantially horizontal portion of the corresponding track.

8. The patio cover and storm protection device of claim 1 further comprising a fascia coupled to the building structure at an elevation higher than an elevation of the substantially horizontal portion of the at least one track and being located proximate the substantially horizontal portion of the at least one track, the fascia being capable of diverting liquid away from the building structure.

9. The patio cover and storm protection device of claim 1 wherein the substantially horizontal portion of each at least one track being pitched so the distal end of the substantially horizontal portion of each at least one track being at an elevation lower than an elevation of the proximate end of the substantially horizontal portion of each at least one track.

10. A patio cover and storm protection device comprising:

at least one screen, each at least one screen having a front face and a back face and a first side and a second side and a top side and a bottom side;

at least one track, each at least one track comprising:

a substantially vertical portion having a higher end and a lower end, the substantially vertical portion coupled to a building structure;

a curved portion having a vertical end and a horizontal end, the vertical end being coupled to the higher end of the substantially vertical portion; and a substantially horizontal portion having a proximate end and a distal end, the proximate end being coupled to the horizontal end of the curved portion and the distal end of the substantially horizontal portion extending away from the building structure;

at least one track roller coupled to each at least one screen, the at least one track roller dimensioned to permit the at least one screen to travel along the at least one track so that at least a portion of the at least one screen being disposed anywhere between a substantially vertical position covering the building structure and a substantially horizontal position extending away from the building structure; and a support means coupled to the track.

11. The patio cover and storm protection device of claim 10 further comprising a motorized drive mechanism for causing the at least one track roller to move along the at least one track.

12. The patio cover and storm protection device of claim 11 wherein the driving mechanism being remotely operable.

13. The patio cover and storm protection device of claim 10 comprising:

wherein the at least one track comprises two tracks, wherein the vertical portion of each track is coupled to a building structure, and wherein the horizontal portion of each track extends outwardly from the building structure;

wherein the at least screen is disposed between the two tracks; and wherein the at least one track roller comprises a first set of track rollers and a second set of track rollers, wherein the first set of track rollers are coupled along a first side of the at least one screen, each of the track rollers of the first set having a first end coupled to the first side of the at least one screen and a second end coupled to one of the two tracks, and wherein the second set of track rollers are coupled along a second side of the at least one screen, each of the track rollers of the second set having a first end coupled to the second side of the at least one screen and a second end coupled to the other of the two tracks.

14. The patio cover and storm protection device of claim 10 wherein the support means comprises at least one support member coupled at one end to the substantially horizontal portion of the track and extends perpendicularly to the ground.

15. The patio cover and storm protection device of claim 13 wherein the at least one track comprises two tracks, and wherein the support means comprises two support members, one support member coupled at one end to the substantially horizontal portion of one track and extending perpendicularly to the ground and another support member coupled at one end to the substantially horizontal portion of the other track and extending perpendicularly to the ground.

16. The patio cover and storm protection device of claim 10 comprising:

said at least one track comprising a first outer track, a second outer track, and a middle track;

said at least one screen comprising a first screen and a second screen, said first screen disposed between the first outer track and the middle track, and said second screen disposed between the middle track and the second outer track;

said at least one track roller comprising a first set of track rollers, a second set of track rollers, a third set of track rollers, and a fourth set of track rollers;

the first set of track rollers coupled along an outer side of the first screen, each of the track rollers of the first set having a first end coupled to the outer side of the first screen and a second end coupled to the first outer track;

the second set of track rollers coupled along a middle side of the first screen, each of the track rollers of the second set having a first end coupled to the middle side of the first screen and a second end coupled to one side of the middle track;

the third set of track rollers coupled along a middle side of the second screen, each of the track rollers of the third set having a first end coupled to the middle side of the second screen and a second end coupled to the other side of the middle track; and the fourth set of track rollers coupled along an outer side of the second screen, each of the track rollers of the fourth set having a first end coupled to the outer side of the second screen and a second end coupled to the second outer track.

17. The patio cover and storm protection device of claim 16 comprising a first motorized drive mechanism for the causing the first screen to move along the first outer track and the middle track and a second drive mechanism for causing the second screen to move along the middle track and the second drive mechanism, wherein the first motorized drive mechanism and the second drive mechanism are independently operable.

18. A patio cover and storm protection device comprising:

two tracks, each track having a vertical portion coupled to a building structure and a horizontal portion, said horizontal portion comprising a proximate end and a distal end, wherein the proximate end is closer to the vertical portion than the distal end, wherein the distal end extends outwardly away from the building structure;

a screen disposed between the two tracks;

a first set of track rollers coupled along a first side of the screen, each of the track rollers of the first set having a first end coupled to the first side of the screen and a second end coupled to one track;

a second set of track rollers coupled along a second side of the screen, each of the track rollers of the second set having a first end coupled to the second side of the screen and a second end coupled to the other track;

a first support member coupled at one end to the horizontal portion of one track and extending perpendicularly to the ground;

a second support member coupled at one end to the horizontal portion of the other track and extending perpendicularly to the ground; and a motorized drive mechanism for causing the screen to move along the tracks;

wherein the tracks are pitched so a distal end of the horizontal portion of each track is lower in elevation than a proximal end of the horizontal portion of each track.

* * * * *